United States Patent [19]

Dufour

[11] Patent Number: 4,974,387

[45] Date of Patent: Dec. 4, 1990

[54] FACTORY MADE LIGHT STEEL JOINT FOR ROOF TRUSSES

[76] Inventor: Karl Dufour, 936 Monaco, St. Hilaire, Quebec, Canada, J3H 4R8

[21] Appl. No.: 394,131

[22] Filed: Aug. 15, 1989

[51] Int. Cl.[5] ..... E04B 1/32

[52] U.S. Cl. ..... 52/639; 52/643; 52/93

[58] Field of Search ..... 52/639, 93, 643, 90, 52/721; 403/174, 178, 205; 29/150, 155 R

[56] References Cited

U.S. PATENT DOCUMENTS

| | | | |
|---|---|---|---|
| 797,474 | 8/1905 | Walker . | |
| 1,760,883 | 6/1930 | Moss . | |
| 2,201,504 | 5/1940 | Ruppel | 52/643 X |
| 2,931,129 | 4/1960 | Boniface | 46/17 |
| 3,429,602 | 4/1968 | Dirilgen | 287/189.36 |
| 4,076,432 | 2/1978 | Glaser | 403/176 |
| 4,315,386 | 2/1982 | Clarke | 52/93 |
| 4,551,957 | 4/1985 | Madray | 52/90 |
| 4,688,358 | 8/1987 | Madray | 52/721 X |

FOREIGN PATENT DOCUMENTS

| | | | |
|---|---|---|---|
| 637526 | 3/1962 | Canada . | |
| 1058376 | 7/1969 | Canada | 20/122 |
| 960429 | 1/1975 | Canada | 20/118 |
| 968124 | 5/1975 | Canada | 20/122 |
| 1052524 | 4/1979 | Canada | 20/118 |
| 1229153 | 9/1960 | France . | |

OTHER PUBLICATIONS

PCT application U.S. 84/00782, Madray, 12-1984.

*Primary Examiner*—David A. Scherbel
*Assistant Examiner*—Creighton Smith
*Attorney, Agent, or Firm*—Eckert, Seamans, Cherin & Mellott

[57] ABSTRACT

A braced framework comprises a truss, supported at its ends, on vertical studs. The latter and the adjacent truss chords are connected together at eaves joints and the truss top chords are connected together at a ridge joint. Each joint includes a metal connector having a connection leg for each of the truss chords and studs. The connection legs are channel elements each defining a chamber into which one chord is received, each chamber having a front opening and the chords being frame members each formed with an open web. As a result, once the chords are inserted into the connection leg chambers of the metal connectors, the assembly of the frame members and the connection legs, at each joint, may be carried out by welding from the front openings of the chambers and through the open webs of the frame members, thereby avoiding having to lift the framework and turn it upside down.

17 Claims, 3 Drawing Sheets

FACTORY MADE LIGHT STEEL JOINT FOR ROOF TRUSSES

BACKGROUND OF THE INVENTION

1. Field of the Invention

The present invention relates to a method of welding together the ends of frame members at joints of a braced framework, such as a roof truss mounted at the upper ends of a pair of studs. The invention also relates to a framework resulting from this welding method.

2. Description of the Prior Art

It is already known in the art to connect the ends of elongated frame members, of such structures as roof trusses, by means of hollowed out prefabricated metal connectors into which the ends of the frame members are slid to be thereafter either bolted or riveted. They may also be welded between a pair of reinforcing plates. The assembly work is done either at the factory or preferably on the erection site because the separated building components may then be shipped much more easily and cheaply than shipping the whole truss as assembled at the factory. Typical of this type of construction is that disclosed in U.S. Pat. Nos. 4,315,386 of Feb. 16, 1982; 4,551,957 of Nov. 12, 1985 and in International Application No. WO 84/04771 published on Dec. 6, 1984.

The difficulty with the presently existing methods of assembling the components of such structures, at the joints, whether by bolts, rivets or by welding, is that the assembly can only be achieved by working on both sides of the components which thus requires that the structures be lifted and turned upside down.

It will be appreciated that, because the structure is large, cumbersome and heavy, the handling alone represents a time-consuming, arduous and consequently costly task.

SUMMARY OF THE INVENTION

An object of the present invention lies in providing a method of assembling the structural components, at the frame joints, exclusively by welding and working solely from the same face of the joints so as to avoid having to lift the framework and turn it upside down.

Another objet of the invention is to propose a braced framework so structurally conceived at the joints that it makes the above method applicable.

The invention is more specifically concerned with a method of assembling the frame members and connector of a joint including at least two elongated metal frame members secured together by a metal connector having at least two connection legs, one for each of the members, which method comprises the steps of selecting a metal connector of which each connection leg is a channel element having a web and a pair of flanges perpendicular thereto, the web and flanges defining an inner chamber having a front opening on the side thereof opposite the web; selecting frame members each including a pair of outward elongated spaced parallel shoes and open-web means joining the shoes; selecting the size and shape of the frame members for fitting into the chambers; fitting the frame members into the chambers, respectively; and welding the web means and shoes of the frame members to the web and flanges of the connector legs, respectively, by working solely from the front openings of the connection leg chambers.

According to a preferred embodiment, the connector is selected such that the free ends of the connection leg flanges are toward one another and form lips defining the front openings, and the selected frame members define rabbets with the lips and with the connection leg webs. According to this embodiment, the welding is applied into the rabbets.

Preferably, the shoes of at least one of the frame members are U-shaped elements turned toward one another and have tabs that overlap the lips and the adjacent connection leg web to define rabbets between them, welding being again applied at least partly into these rabbets.

As said before, the invention relates also to a braced framework resulting from the above method.

Further objections and advantages of the invention will become apparent from the description that follows of preferred embodiments, having reference to the appended drawings.

DESCRIPTION OF THE PREFERRED EMBODIMENTS

Figure 1:
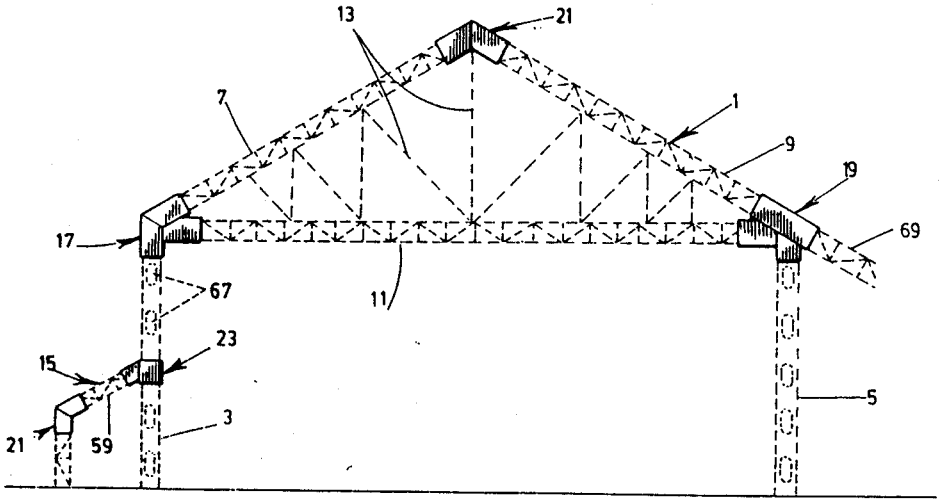
FIG. 1 is a side elevation view of a roof truss resting on side studs and including joints, made according to the teaching.

FIG. 1 shows a braced frame work in the form of a roof truss 1 fixed to side studs 3, 5. The truss 1 is made up of top chord inclined rafters 7, 9, and of girder 11 acting as the lower chord. Shown in broken lines only, are web members 13 that may be used to strengthen the truss where necessary. A lean-to 15 is seen attached to the stud 3. It will be noted that the rafter 9 extends beyond the stud 5 for use where an overhanging roof is required.

As shown, the studs 3, 5 the rafters 7, 9, and the girder 11 all are elongated metal structural frame members that may vary in design. They are secured together at the joints by eaves metal connectors 17, 19; ridge metal connectors 21 and lean-to metal connector 23 into which they are received. The eaves connector 17 is typical of the type used for carrying out the invention and is the one shown in FIGS. 2 and 3. Ridge connectors 21 and lean-to connector 23 variants including the inventive features of the connector 17.

The latter has three connection legs 25, 27, 29, each intended to receive one of the frame members 3, 7, 11. In turn, all legs 25, 27, 29 have the same cross-sectional shape but, however, must of course be sized to suit the frame members it is intended to receive. At the joints, the frame members may be of the same design, as in FIG. 3, or different, as in FIG. 2.

The connection legs are channel members having webs 31, 33, 35, joining their respective flanges 37, 39, 41. The free ends of the latter are turned inwardly toward one another and form lips 42 so that the legs have a general C-shape, in cross-section. The legs thus define inner chambers, only chambers 43, 45, being shown in FIG. 2; the tips of the lips 42 delimiting a front opening for the chambers.

As shown, all webs 31, 33, 35, of the connection legs 25, 27, 29 of the connector 17 lie in a common plane. The legs are welded together along meeting lines of the webs and flanges and such as to preserve the angles at which the frame members 3, 7, and 11 must meet.

The elongated frame members 3, 7, 11, are shaped and sized to fit snuggly but slidably into their respective chamber. Each member includes a pair of outward elongated shoes flatly applied against the flanges 37, 39, 41, when telescoped into the receiving chambers 43, 45 and that, not shown, of leg 27. The shoes are interconnected by web means which must be of the open type.

Figure 2:
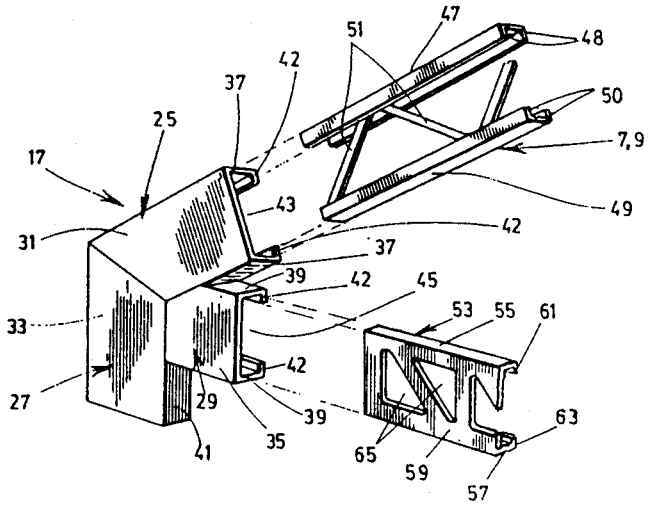
FIG. 2 is an exploded perspective view of a joint according to the invention.

Thus, in FIGS. 1 and 2, the girder 7 is a frame member having a pair of shoes 47, 49, with depending tabs 48, 50, running the full length of the shoes 47, 49. The latter are interconnected by a continuous V-bent bar 51 welded, at its apices, to the shoes 47, 49, so as to provide an open structure.

The girder 53, in FIG. 2, is another type of frame member that can be used. It has a pair of shoes 55, 57, interconnected at one end by a web 59 and bent, at the other end, into tabs 61, 63. In order for this frame member to be of the open type, the web 59 is formed with apertures 65 along its length. In FIG. 2, these apertures are successively upright and inverted triangles. These apertures can be oval as at 67 through the web of the stud 3 in FIG. 1; the stud being otherwise a frame member of the same type as the girder 53.

Figure 3:
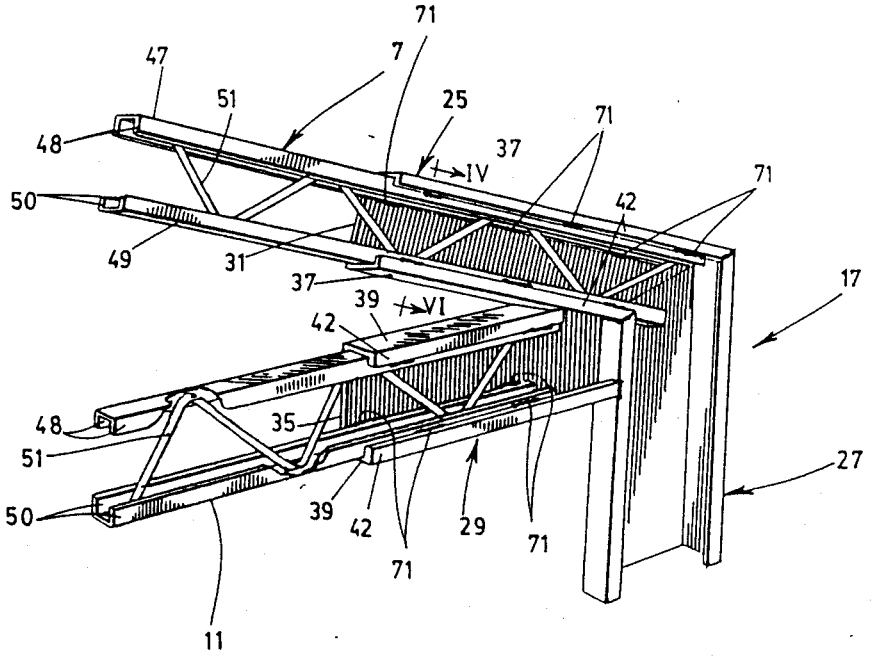
FIG. 3 is a perspective view of a joint according to another embodiment of the invention.

It will be appreciated from FIGS. 1, 2 and 3 and from the above description that any conventional frame member may be used provided it has an open structure between the outward shoes and provided also, of course, that its size and shape as well as those of the chambers 43, 45, be so related that the frame members may fit snuggly into the receiving chambers 43, 45. Where cooperating lips and tabs 48, 50, 61, 63, are provided, the frame members may safely and accurately be telescoped in the connection leg chambers.

The eaves connector 19, at the right of FIG. 1, is the same as connector 17 except that, as compared thereto, its inclined leg 25 extends beyond the vertical leg 27 to form an additional chamber for receiving an eaves rafter 69.

The ridge connector 21, are two-legged and otherwise the same as connector 17 but with leg 29 removed.

To resume, the practice of the invention requires that the components of each joint be selected so as to comprise: a metal connector having at least two channel-shaped connection legs, defining chambers having a front opening, and at least two frame members each received into one of the chambers; the frame members including a pair of outward shoes interconnected by an open web. With this structural arrangement and once the frame members are fitted into the connector chambers, the frame members are welded to both the web and flanges of the metal connectors and this step of the method is carried out from the same side of the joint, due to the presence of the front openings of the chambers and of the open web structure of the frame members, as can best be seen in FIG. 3. The length of the frame members inserted into the chambers should be long enough so that spot welds 71 be sufficient to safely secure the parts together.

Figure 4:
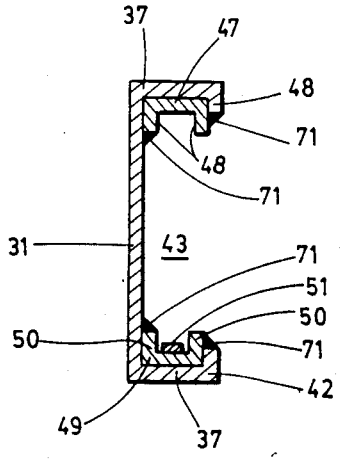
FIG. 4 is a cross-sectional view in a plane along line IV—IV of FIG. 3.

Referring to FIG. 4, the lips 42 are shorter than the adjacent overlapping tabs 48, 50, so that the two define rabbets between them into which the welding 71 is applied. At the bottom of chamber 43, the rabbets are formed between the solid web 31 and the inward tabs 48, 50.

Figure 5:
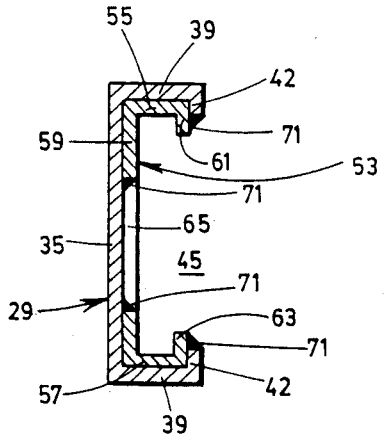
FIG. 5 is a view similar to that in FIG. but according to the embodiment of FIG. 2.

In FIG. 5, the cross-section is that across the connection leg 29 and the frame member 53 of FIG. 2 once the latter has been telescoped into the former. The situation across the front opening of the chamber 45 is the same as the like structure in FIG. 4. Inwardly of the chamber, however, the rabbets are formed by the circumscribing edges of the triangular apertures 65 (see FIG. 2) and the adjacent solid web 35 of the connection leg 29.

Figure 6:
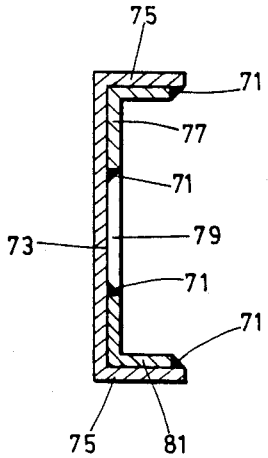
FIG. 6 is a cross-sectional view similar to that of FIG. 5 but of still another embodiment.

FIG. 6 shows a variant of the structure of FIG. 5. Here, the connection leg is a pure channel member having a solid web 73 and straight flanges 75 without depending lips. The frame member is likewise a pure channel member having an open web 77, with apertures 79, and straight shoes 81. The latter are made shorter than the flanges 75 and welding rabbets are formed between them. While this is a structurally simpler solution, it may however require additional means for temporarily holding the frame members and the connection leg together during welding which is still less troublesome than turning the structure over.

It may be understood that the method according to the invention could similarly be carried out if use is made of C-shaped frame members like the one numbered 53 in FIG. 2, whose size is so related to the size of the connection legs 25, 27, 29 that the frame members may fit snuggly not into, but rather externally over the connector legs. In such a case, the resulting assembly would be similar to the one shown in FIGS. 5 or 6, except that reference numeral 53 would then identify the connection leg and reference numeral 29 would identify the frame member.

To make this "reversal" operative, it is of course compulsory that the welding step be still capable of being carried out from the same side of the joint, namely from the front opening of the chamber 45. This makes it compulsory for the webs of the connection legs to be provided with cut out openings through which welding would be carried out, as is done through openings 65 or 79 in FIG. 5 or 6.

The last steps of the method according to the invention may thus differ from those previously recited, in that they call for:

selecting the size and shape of said frame members for fitting externally over said connection legs;

fitting said frame members over said connection legs, respectively; and welding said web and flanges of said connector legs, respectively, to said web and parallel shoes of said frame members by working solely from said other front openings of said frame members.

The result will however be the same.

I claim:

1. In an essentially flat braced framework comprising a plurality of joints each including at least two elongated metal frame members secured together by a metal connector having at least two connection legs, one for each of said members, a method of assembling said frame members and connector together at each of said joints, said method comprising:

selecting a metal connector of which each connection leg is a channel element having a web and a pair of flanges perpendicular thereto, said web and flanges defining an inner chamber having a front opening on the side thereof opposite said web;

selecting frame members including a pair of outward elongated spaced parallel shoes and open-web means joining said shoes;

selecting the size and shape of said frame members for, fitting into said chambers;

fitting said frame members into said chambers, respectively; and welding said web means and parallel shoes of said frame members to said web and flanges of said connector legs, respectively, by working solely from said front openings of said connection leg chambers.

2. A method as claimed in claim 1, wherein the free ends of said connection leg flanges are turned toward one another and form lips defining said front openings, and wherein said frame members define rabbets with said lips and with said connection leg webs; said method further comprising:

applying said welding into at least some of said rabbets.

3. A method as claimed in claim 2, wherein said shoes of at least some of said members are U-shaped elements turned toward one another and have tabs overlapping said lips and the adjacent connection leg web to define rabbets therebetween.

4. A method as claimed in claim 3, wherein said lips are shorter than the overlapping tabs adjacent thereto.

5. A method as claimed in claim 1, wherein the free ends of said connection leg flanges are turned toward one another and form lips defining said front openings; wherein the ends of said shoes adjacent said lips define rabbets therewith and wherein said open web means of at least one of said frame members is a flat plate lying flatly against the connection leg web adjacent thereto, said plate having at least one aperture therethrough, wherein the circumscribing edge of said aperture defines a rabbet with the adjacent connecting leg; said method comprising:

applying said welding into at least part of said rabbets.

6. A method as claimed in claim 5, wherein said adjacent ends of said shoes are turned toward one another into tabs overlapping said lips and forming said rabbets therewith.

7. A method as claimed in claim 6, wherein said shoes of at least one of said frame members are U-shaped elements turned toward one another and have tabs overlapping said lips and the adjacent connection leg web to define rabbets therebetween.

8. A method as claimed in claim 1, wherein said shoes of at least one of said frame members terminate short of the adjacent connection leg flanges to define rabbets therewith; wherein said open web means is a flat plate laying flatly against the adjacent connection leg web, said plate having at least one aperture therethrough; wherein the circumscribing edge of said aperture defines a rabbet with said connection leg web; said method comprising:

applying said welding into at least part of said rabbet.

9. An essentially flat braced framework comprising a plurality of joints of which each include at least two elongated metal frame members and a metal connector having at least two connection legs, one for each of said frame members, each of said joints being further characterised by:

each of said connection leg being a channel element with a web and a pair of flanges perpendicular thereto, said web and flanges defining an inner chamber having a front opening on the side thereof opposite said web;

each of said frame members fitting into one of said chambers and including: a pair of outwardly elongated shoes flatly applied against said connection leg flanges, and open-web means joining said shoes; means defining rabbets between said frame members and said connection legs, said rabbets facing toward said front openings; and weld means in said rabbets.

10. A framework as claimed in claim 9, wherein the free ends of said connection leg flanges are turned toward one another and form lips defining said front openings, and wherein said frame members define rabbets with the said lips and with said connection leg webs.

11. A framework as claimed in claim 9, wherein said shoes of at least one of said frame members are U-shaped elements turned toward one another and have tabs overlapping said lips and the adjacent connection leg web to define rabbets therebetween.

12. A framework as claimed in claim 10, wherein said lips are shorter than the overlapping tabs adjacent thereto.

13. A framework as claimed in claim 9, wherein the free ends of said connection leg flanges are turned toward one another and form lips defining said front openings; wherein the ends of said shoes adjacent said lips define rabbets therewith and wherein said open web means of at least one of said frame members is a flat plate laying flatly against the connection leg web adjacent thereto, said plate having at least one aperture therethrough, and wherein the circumscribing edge of said aperture defines a rabbit with the adjacent connection leg web.

14. A framework as claimed in claim 13, wherein said adjacent end of said shoes are turned toward one another in two tabs overlapping said lips and forming rabbets therewith.

15. A framework as claimed in claim 9, wherein said shoes of at least one of said frame members terminate short of the adjacent connecting leg flanges to define rabbets therewith; wherein said open web means is a flat plate lying flatly against the adjacent connection leg web, said plate having at least one aperture therethrough, and wherein the circumscribing edge of said aperture defines a rabbet with said connection leg web.

16. A framework as claimed in claim 9, wherein said web of said connection legs are solid webs.

17. In an essentially flat braced framework comprising a plurality of joints each including at least two elongated metal frame members secured together by a metal connector having at least two connection legs, one for each of said members, a method of assembling said frame members and connector together at each of said joints, said method comprising:

selecting a metal connector of which each connection leg is a channel element having a web provided with openings, and a pair of flanges perpendicular to said web, said web and flanges defining an inner chamber having a front opening on the side thereof opposite said web;

selecting frame members including a pair of outward elongated spaced parallel shoes interconnected by a web defining another front opening;

selecting the size and shape of said frame members for fitting externally over said connection legs;

fitting said frame members over said connection legs, respectively; and welding said frame members and flanges of said connector legs, respectively, to said web and parallel shoes of said frame members by working solely from said other front openings of said frame members.

* * * * *